United States Patent [19]

Ciula

[11] Patent Number: 4,845,866

[45] **Date of Patent: * Jul. 11, 1989**

[54] PLASTIC MOLDBOARDS FOR SNOW PLOWS AND THE LIKE

[75] Inventor: James C. Ciula, Mentor, Ohio

[73] Assignee: The Louis Berkman Company, Cleveland, Ohio

[ * ] Notice: The portion of the term of this patent subsequent to Feb. 14, 2006 has been disclaimed.

[21] Appl. No.: 279,875

[22] Filed: Dec. 5, 1988

Related U.S. Application Data

[63] Continuation of Ser. No. 174,142, Mar. 28, 1988, Pat. No. 4,803,790.

[51] Int. Cl.[4] ..... E01H 5/06

[52] U.S. Cl. ..... 37/266; 172/701.1; 172/747

[58] Field of Search ..... 37/266, 231, 234, 270, 37/279, 281, 284; 172/701.1, 747

[56] References Cited

U.S. PATENT DOCUMENTS

| | | | |
|---|---|---|---|
| 3,432,947 | 3/1969 | Peitl | 37/281 |
| 3,465,456 | 9/1969 | Meyer | 37/233 |
| 4,439,939 | 4/1984 | Blau | 37/231 |
| 4,574,502 | 3/1986 | Blau | 37/266 |

OTHER PUBLICATIONS

Brochure from American Hoechst Corporation, Plastics Div.

*Primary Examiner*—Edgar S. Burr
*Assistant Examiner*—Moshe I. Cohen
*Attorney, Agent, or Firm*—Body, Vickers & Daniels

[57] ABSTRACT

An improved blade for a snow plow is provided. The blade includes an inwardly curved, polyethylene moldboard which is secured in a prestressed and arcuate relationship to a structural frame. The frame includes inwardly curved, vertically extending, transversely spaced brace members and a defined space of predetermined shape exists between the moldboard and the braces for improved snow removal by the blade.

4 Claims, 7 Drawing Sheets

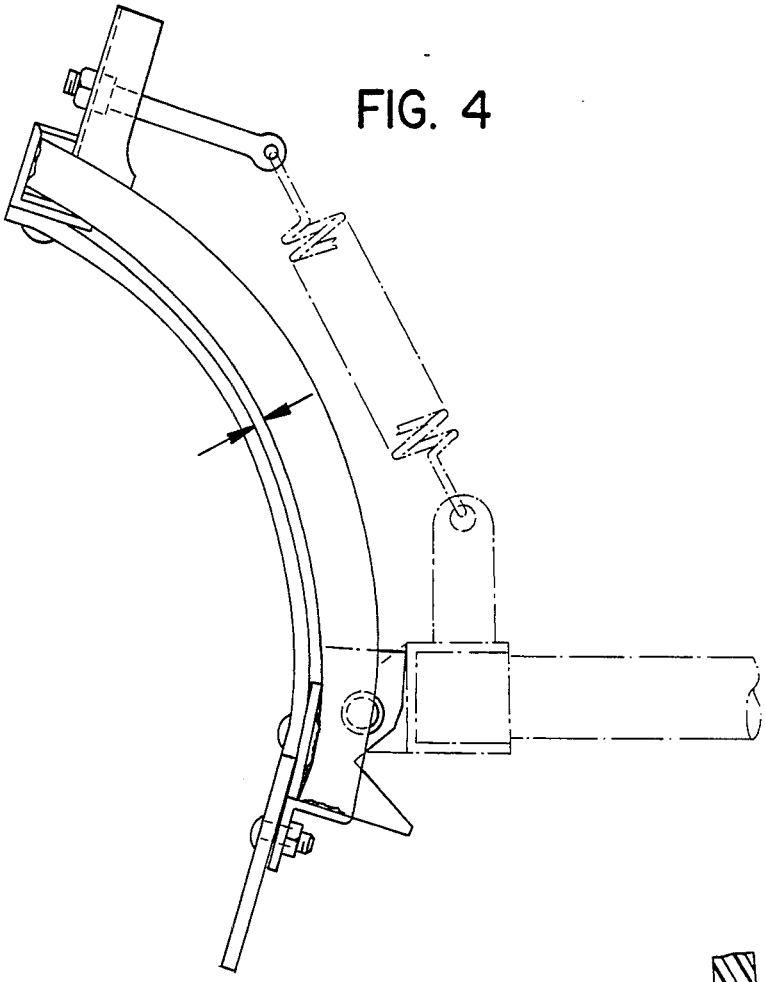
FIG. 4
FIG. 5
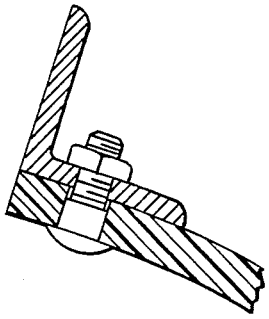
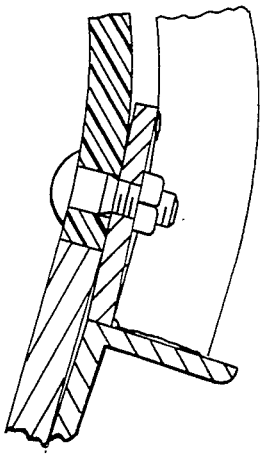
FIG. 6

PLASTIC MOLDBOARDS FOR SNOW PLOWS AND THE LIKE

This is a continuation of application Ser. No. 174,142 filed Mar. 28, 1988, now U.S. Pat. No. 4,803,790.

BACKGROUND OF THE INVENTION

This invention relates generally to plows and more particularly to an improvement in snow plows and similar devices for cleaning snow and other debris from roadways and similar surfaces.

The invention is particularly applicable to a snow plow apparatus and construction, whereby an improved moldboard is provided and will be described with particular reference thereto. However, the invention may have broader applications and could be used, in theory, for plows for other applications such as agricultural purposes and the like.

A plow of the type used to remove snow from a roadway must include a blade which rolls the snow upwardly and then moves it transversely across the face of the blade. To accomplish this, the plow includes a moldboard having a curvilinear configuration which terminates in a lower plowing edge or a scraper blade. The scraper blade usually extends in a forward direction and, in effect, digs into the snow and forces the snow onto the curvilinear moldboard. The contour of the moldboard imports a rolling action to the upwardly moving snow and forces the snow transversely across the face of the moldboard and to the side of the plow.

Over the years many different moldboard configurations of various curvilinear shapes have been experiment with to arrive at a shape which would insure smooth rolling and transverse movement of wet and powdery snow across the moldboard face. A curvilinear configuration, essentially arcuate in shape and extending in only one planar direction has proven an acceptable, widely used geometrical configuration for the moldboard.

A typical snow plow construction is to roll a mild steel carbon plate, typically of about ⅛", into an arcuate shape to form the moldboard. The framework, typically constructed from structural angle members, is then welded to the rear side of the moldboard to support and prevent the moldboard from fracturing when being hit by rock and other debris from the roadway while also providing the structure for the attachments necessary to operate the plow. Typical examples of such construction may be found by reference to U.S. Pat. No. 3,432,947 to Peitl and 3,465,456 to Meyer assigned to the current assignee and incorporated herein by reference.

From a consideration of plow weidht, a steel moldboard is undesirable. It obviously places greater force requirements on the vehicle to which it is attached, and perhaps more importantly requires heavier plow attachments and larger lifting systems than what otherwise may be possible.

From an efficiency consideration, a number of attempts have been made to improve the efficiency of the steel moldboard in plows of the aforesaid type so as to better enhance the rolling motion and transverse movement of the snow across the face of the moldboard. Many of the approaches fundamentally involve a lowering of the coefficient of friction of the surface of the moldboard. For example, wax has long been used by snow plow operators on the moldboard. Moldboards have also been permanently coated with various substances. However, such coating eventually fail when struck by rocks, stones and other debris from the roadway which impact the moldboard under significant forces.

A number of various materials having extremely low coefficients of friction exist in the art. In particular, ultra high molecular weight polyethylenes have been developed and applied in industrial application where sliding contact is encountered as for example as liners for chutes and bunkers, as wear strips, slide plates, bearings and bushings. Until now, considerations relating to the mechanical properties of such materials have ruled out the suitability of such materials for use as a moldboard in a snow plow application.

More recently, on the basis of weight and cost considerations alone, various types of other plastics have been used as moldboards in snow plows. The plastic is preformed into the desired curvilinear shape and applied flush against the frame where it is drilled and fastened in place in the same manner that the steel moldboard is conventionally applied to the frame. Depending upon the properties of the plastic and its durability, plastic moldboards have met with limited success.

SUMMARY OF THE INVENTION

Accordingly, it is one of the principal objects of the present invention to provide a snow plow and a method of constructing a snow plow which utilizes a high molecular weight polyethylene material as a moldboard to produce a durable, lightweight and significantly improved snow plow.

This object along with other features of the invention is achieved in a plow of the type used to clear snow and debris from roadways and similar surfaces. The plow comprises, essentially, a conventional frame which includes a top and a bottom longitudinally extending mounting member approximately equal to the length of the plow blade and a plurality of vertically extending, transversely spaced brace members. Each brace member is fixedly secured at one end to the top mounting member and at its opposite end to the bottom mounting member and has inwardly curved forward edge surfaces extending between the top and bottom member. A generally rectangular and inwardly curved polyethylene moldboard of high molecular weight is fastened by fastening means to the top and bottom mounting members in an inwardly curved, flexed and prestressed manner but the rearward surface of the moldboard is spaced away from the forward edge surface of the brace members a fixed distance. This distance is normally sufficient to prevent contact therebetween during operation of the plow while permitting brace contact during excessive debris impact. The moldboard is essentially prestressed when assembled in the frame in a preferred curvilinear shape whereby the rigidity and resiliency of the curvilinear moldboard shape is enhanced to provide good rolling and transverse movement of the snow during normal operation of the plow while the braces in the frame prevent an excessive distortion and/or fracture of the moldboard should debris from the roadway severely impact the moldboard.

In accordance with another aspect of the invention, the mounting members and braces are formed of structural angle members and a flat, longitudinally extending mounting plate abuts the bottom mounting angle and is generally co-planar with the mounting leg of the bottom angle while secured to the inwardly curved forward edge surfaces of the braces. The bottom portion of the moldboard is secured to the mounting plate and the top portion of the moldboard is secured to the mounting leg of the top angle which is at a fixed angle relative to the braces to define an offset or spaced distance between the brace and the moldboard. Importantly, in a preferred embodiment of the invention for large plow applications, the spaced distance is crescent or moon-shaped tapering gradually towards the top of the moldboard to provide the desired prestressed, resilient deflection of the moldboard which can be the same thickness for both large and small plow applications.

In accordance with yet another feature of the invention, a scraper blade is conventionally secured to the mounting leg of the bottom angle and abuts the bottom edge of the moldboard to function as a solid stop for the moldboard increasing its rigidity. In one preferred embodiment of the invention, the scraper blade extends onto the flat mounting plate thus increasing the support area for the scraper blade. In the large plow application the bottom edge of the moldboard extends into the mounting leg of the bottom angle to assure the described curvature.

In accordance with another aspect of the invention related to large plow applications, the top edge of the moldboard extends in an unsupported manner at least 3" beyond the mounting leg of the top angle. Heretofore, steel plows had to support the moldboard extension to avoid fracture from rocks and other debris, a consideration not present in the polyethylene moldboard of the subject invention.

In accordance with still another feature of the invention, the frame assembly described above is accurately formed and a plurality of round holes are drilled in transversely spaced increments in the top and bottom mounting members of the frame. A flat sheet of high molecular weight polyethylene moldboard of about $\frac{3}{8}$" thickness has a like plurality of rectilinear holes accurately formed in the flat moldboard equal in number and spacing to the drilled holes and adjacent the top and bottom edges of the moldboard. The moldboard is then rolled into the desired curvilinear shape and subsequently fastened to the frame by means of fasteners having rectilinear shaped shanks under the fastener heads not greater in length than the width of the moldboard whereby the moldboard is forced as the fasteners are tightened into the aforedescribed relationship to provide the desired spacing between the moldboard and the frame braces.

It is thus a principal object of the subject invention to provide an improved snow plow and method of constructing a snow plow.

It is another object of the invention to provide a lightweight snow plow.

It is another object of the invention to provide in a snow plow an improved moldboard which enhances or increases the ability of the moldboard to gather and move snow across the face thereof.

It is yet another object of the invention to provide an improved snow plow which is less expensive than conventional steel snow plows.

Still another object of the invention is to provide an improved snow plow which utilizes a frame requiring less steel than conventional frames.

Yet a further object of the invention is to provide a method for constructing a snow plow using a plastic moldboard which can be accurately and consistently be applied with a fixed curvature to a snow plow frame.

A still further object of the invention is to provide a frame-plastic moldboard assembly for use on a plow which overcomes the disadvantages previously associated with the use of plastics in a plow environment.

These and other objects and advantages of the present invention will become apparent from the following description taken in conjunction with the accompanying drawings which are described below.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein:

FIG. 4 is an end view of the snow plow shown in FIG. 1;

FIGS. 5 and 6 are cross sectional end views taken along lines 5—5 and 6—6 of FIG. 3, respectively, showing certain details of the construction of the plow shown in FIG. 1;

DETAILED DESCRIPTION OF THE INVENTION

Figure 1:
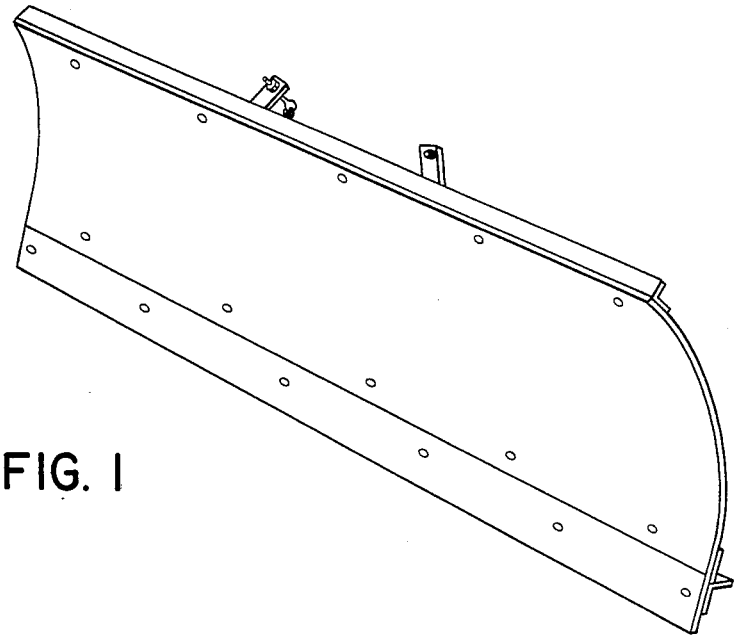
FIG. 1 is a front perspective elevational view of a snow plow of a type typically mounted to a pick-up truck or like vehicle, i.e. a ¢small" snow plow.

Referring now to the drawings wherein the showings are for the purpose of illustrating a preferred embodiment of the invention only and not for the purpose of limiting the same, FIGS. 1–6 illustrate a plow 10 of one type of construction whereas FIGS. 7–10 illustrate a plow 10 of a second type of construction. As indicated above, plow 10, shown in FIGS. 1–6, is suitable for application to pick-up trucks, 4×4 vehicles and the like for light snow removal operations such as encountered in plowing driveways, parking lots, etc. and is typically about 78" in length and will hereafter be referred to as "small" plow 10. The plow shown in FIGS. 7–10 is a larger, heavy duty plow suitable for use by municipalities and governmental agencies for removing snow and debris from roadways and typically has a length of 90" and will hereafter be referred to as "large" plow 10.

Figure 2:
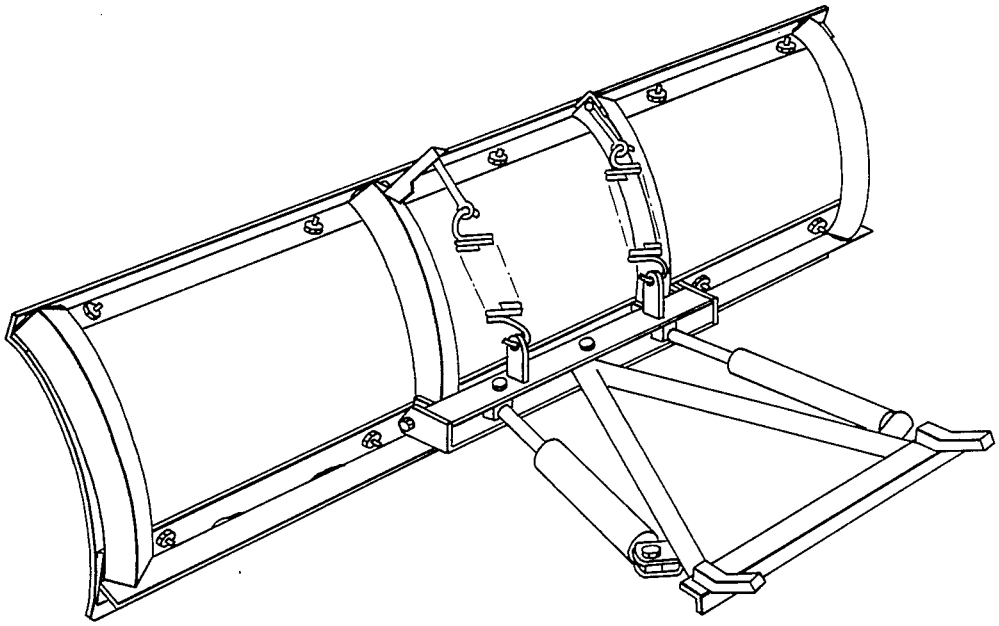
FIG. 2 is a perspective, rear elevation view of the snow plow shown in FIG. 1.

Referring now to FIGS. 1 and 2, plow 10 generally comprises a longitudinally extending structural frame 14, a scraper blade 16 attached to the bottom of the frame 14 and an inwardly curved moldboard 18. For consistency in terminology and as used herein, "scraper blade" means the replaceable, lower edge portion of the plow, while "blade" means the inwardly curved front face 19 of moldboard 18 and the scraper blade 16. Plow 10 means the frame 14, moldboard 18 and scraper blade 16.

Secured or attached to frame 14 are conventional plow accessories which are necessary for operation of plow 10. The accessories include a support crossover arm 20 having journals 21 which are mounted to a vehicle (not shown). Extending from support crossover arm 20 are struts 23 which are pivoted as at 25 to a box-like structure 26. Box structure 26 is pivotally mounted to the bottom portion of frame 14 by a pin connection 28 (FIG. 4). Pin connection 28 permits plow 10 to rotate in a forward or rearward direction. Cylinders 30 mounted on each side of struts 23 permit angling of the plow 10 about pivot 25 so that the attitude of plow 10 relative to the vehicle can be skewed to discharge snow from one side or the other of plow 10.

A first trunnion 33 secured to box structure 26 and a second trunnion 34 secured to the upper end of frame 14 provide the mounting for a spring 36 which maintains plow 10 in an upright position. When scraper blade 16 engages an obstacle in the roadway, plow 10 pivots about pins 28 against the action of springs 36 which return plow 10 to its normal position after passing over the obstacle. The tension of springs 36 is adjusted in a conventional manner by adjustable arms 38 threaded to second trunnion 34.

The accessories thus described are conventional in the plow art and do not, per se, form part of the invention. However, it is specifically contemplated, as part of this invention, that the light weight of moldboard 18 will permit the accessories shown to be redesigned so as to reduce their weight and cost because of the reduction in weight achieved by use of plastic moldboard 18. For general purposes of explanation, conventional accessories are shown.

Figure 3:
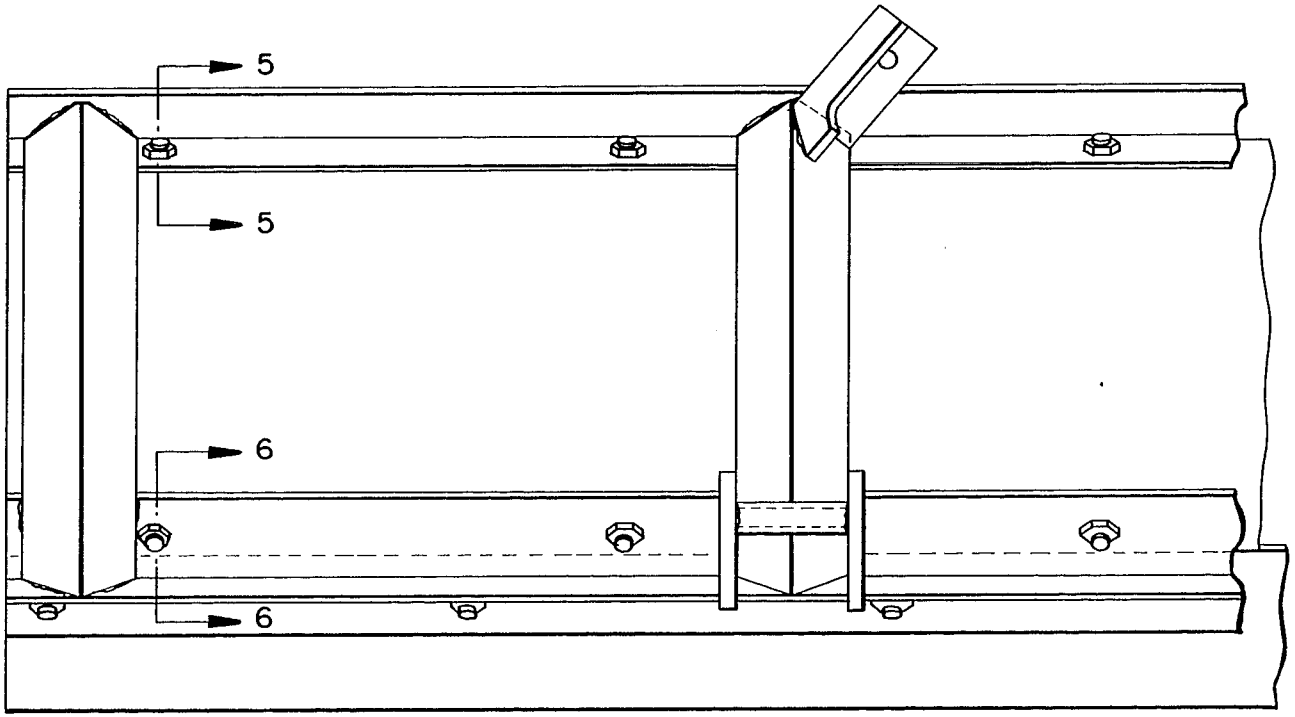
FIG. 3 is a rear elevation view of the snow plow shown in FIG. 1.
Figure 7:
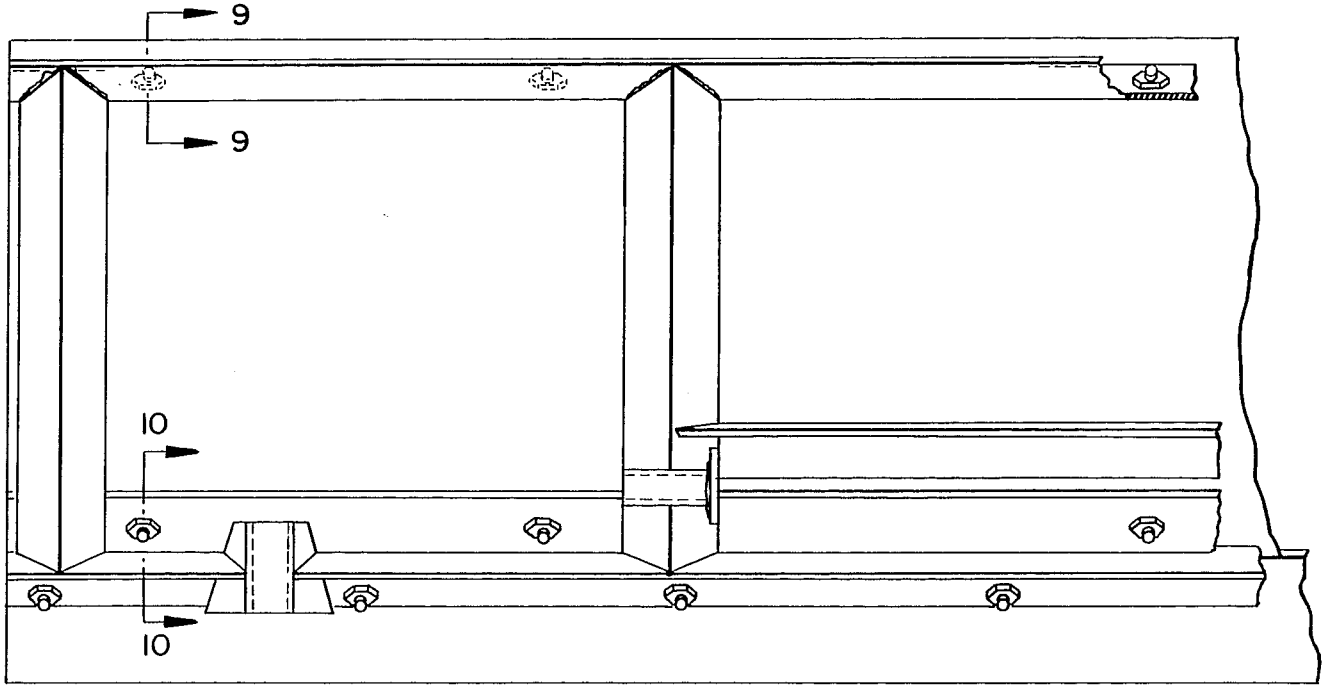
FIG. 7 is a rear elevation view of a snow plow of the type typically used by municipalities and highway departments to clear snow from roadways, highways and interstates, i.e. a "large[ snow plow.
Figure 8:
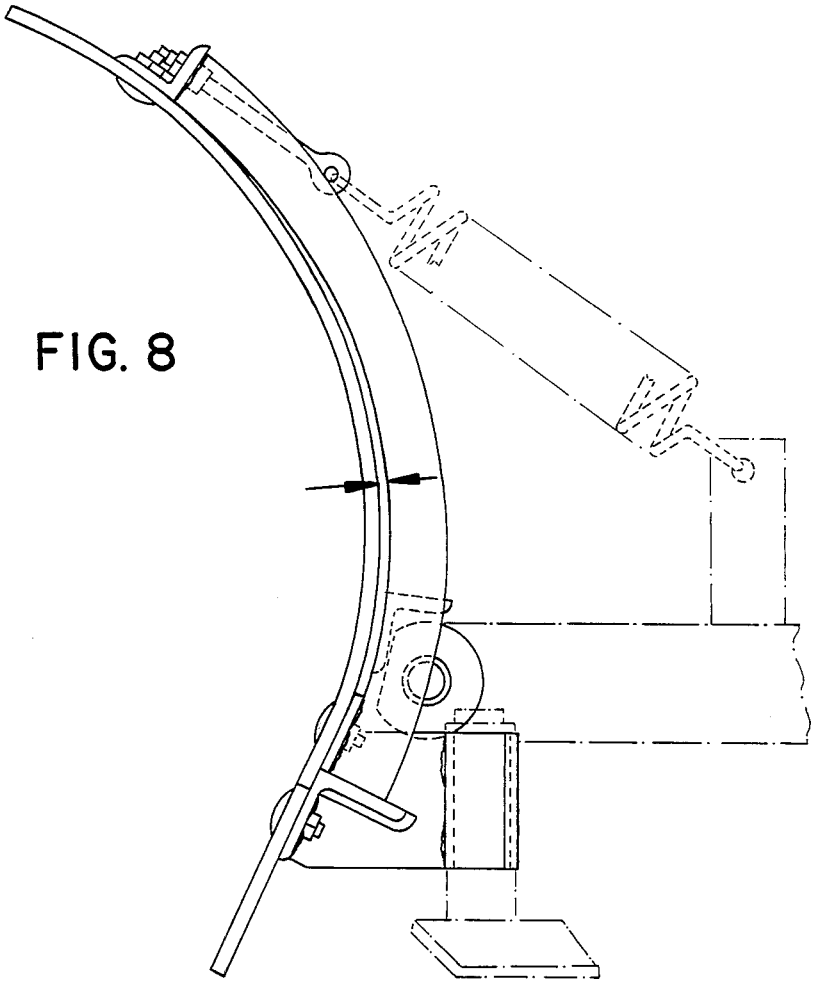
FIG. 8 is an end view of the plow shown in FIG. 7.

Referring now to FIGS. 2, 3 and 4, frame 14 is a somewhat conventional frame similar to that heretofore used on steel snow plows. Generally, frame 14 comprises a longitudinally extending top mounting member 40 which extends the length of the plow, a bottom mounting member 41 which similarly extends the length of the plow and a plurality of transversely spaced, inwardly curved braces 44 which extend between and are secured to top and bottom mounting members 40, 41. In practice, top mounting member 40 is a structural angle having a mounting leg 47 at right angles to a generally radially extending leg 48. Braces 44, similarly, are structural angles which are orientated, as shown in the drawings, to have a V-shaped cross-sectional configuration which is inwardly curved so that the ends of the legs of the angle form inwardly curved forward edge surfaces 50. Preferably, forward edge surfaces 50 of braces 44 are arcuate having a predetermined radius of curvature sized relative to that of moldboard 18. Each brace 44 has a top end 52 which preferably is cut along a radial line coincident with the center with the radius of curvature of forward edge surfaces 50. Mounted flush against top end 52 and welded thereto is radially extending leg 48 of top mounting member 40 and this co-planar line contact assures the position of mounting leg 47 relative to moldboard 18. That is, by changing the angular relationship of top end 52 of brace 44 relative to the radius of curvature of forward edge surfaces 50, the relationship between moldboard 18 and forward edge surfaces 50 can be varied. Similarly, the bottom end 53 of each brace 44 is likewise established, preferably on a radial plane coincident with the center of the radius of curvature of forward edge surfaces 50. Bottom mounting member 41 comprises, in the preferred embodiment, a bottom structural angle 56 and a flat bottom mounting plate 57. Bottom angle 56 has a mounting leg 59 and at right angles thereto a radially extending leg 60. Bottom end 53 of brace 44 abuts against radially extending leg 60 similar to that described for top mounting member 40. Secured to the forward edge surfaces 50 of each brace 44 and adjacent each brace's bottom end 53 is a flat mounting plate 57 which abuts against radially extending leg 60 preferably so that mounting leg 59 of bottom angle 56 and mounting plate 57 are substantially or somewhat co-planar.

As thus far described, frame 14 is constructed by accurately cutting the structural angles, bending braces 44 to the proper degree of curvature and then utilizing conventional jigs and fixtures to hold the members in their proper relationship while they are fixedly welded to one another. Frame 14 illustrated in the drawings and described in the specifications is similar, as noted, to a conventional frame. Because of the light weight of plastic moldboard 18, it is specifically contemplated that the size of the structural angles can be reduced when compared to that used on a steel blade and the weight and cost of frame 14 accordingly reduced. However, the general configuration, and particularly the use of four (4) braces 44, will remain the same.

Figure 12:
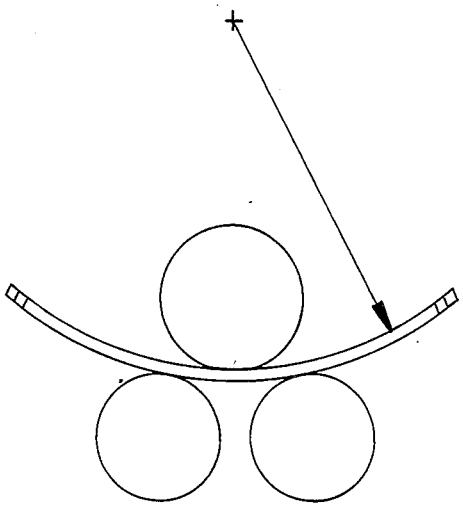
FIG. 12 is a schematic cross-section view illustrating the rolling of the moldboard shown in FIG. 11 into a curvilinear shape.
Figure 13:
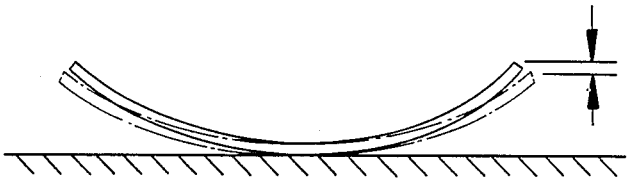
FIG. 13 is an end view of the rolled moldboard of FIG. 12 showing the sag tendencies of the polyethylene moldboard.

Referring now to FIGS. 11–14, a rectangular flat sheet, approximately $\frac{3}{8}$" thick of ultra high molecular weight (UHMW) polyethylene plastic is provided for moldboard 18. An acceptable UHMW plastic marketed under the registered trademark HOSTALEN GUR412 LS and GUR422 is available from American Hoechst Corporation. Data sheets describing the physical properties of the HOSTALEN material are incorporated herein by reference. The UHMW polyethylene material has an exceptionally low coefficient of friction, relative high resistance to abrasion with adequate impact and yield strengths to function in a snow plow environment when appropriate provisions, described herein, are taken. The material does not retain its configuration in a free-standing state and has heretofore been used in industrial applications such as liners and the like where the material could be adequately braced or supported over its entire area. FIG. 13 shows that a UMHW polyethylene material formed into a curvilinear shape (and specifically an arc of 12" radius with a length of 78") will flatten out or vertically drop at its end as much as $\frac{3}{8}$ of an inch (dimension "y") lying on its curved surface in a warehouse overnight at room temperature.

To overcome this problem so that a uniformly inwardly curved moldboard face 19 could be consistently constructed, a flat rectilinear plate 62 of UHMW polyethylene is first provided with a plurality of rectilinear, preferably square shaped, openings 64 extending therethrough adjacent the top edge 65 and bottom edge 66 of plate 62 in a predetermined and precisely spaced manner along the length of plates 62. Conventional rollers 70, 71 used to form steel moldboards for conventional blades, are then utilized as schematically illustrated in FIG. 12 to inwardly curve rectilinear plate 62 into the shape of moldboard 18 so that inwardly curved front face 19 is formed as an arcuate segment having a radius "y". Preferably, for a small plow the curvature of moldboard 18 is defined by an arc having a radius of 12 " while a large plow is defined by an arc "y" having a radius of 15".

Referring now to FIGS. 1, 3, 4 and 14, a longitudinally extending, rectangularly shaped, conventional scraper blade 16 formed from a hardened steel is provided. Other types of scraper blades such as illustrated in U.S. Pat. No. 3,465,456 may be used. Scraper blade 16 has a bottom edge 76 adapted to contact the roadway for picking up snow in a known manner and a top edge 77. A plurality of conventional fasteners 80 are used to fasten scraper blade 16 to mounting leg 59 of bottom angle 56. For the small plow application, top edge 77 of scraper blade 75 extends almost midway across flat bottom mounting plate 57 so that mounting leg 59 of bottom angle 56 and also bottom mounting plate 57 support in a rigid manner the attachment of scraper blade 75 to frame 14. This reduces the length of mounting leg 59 otherwise required to support scraper blade 75. Fasteners 80 are of the conventional type with button heads and either elastomeric lock nuts 81 or conventional nuts with lock washers.

Figure 14:
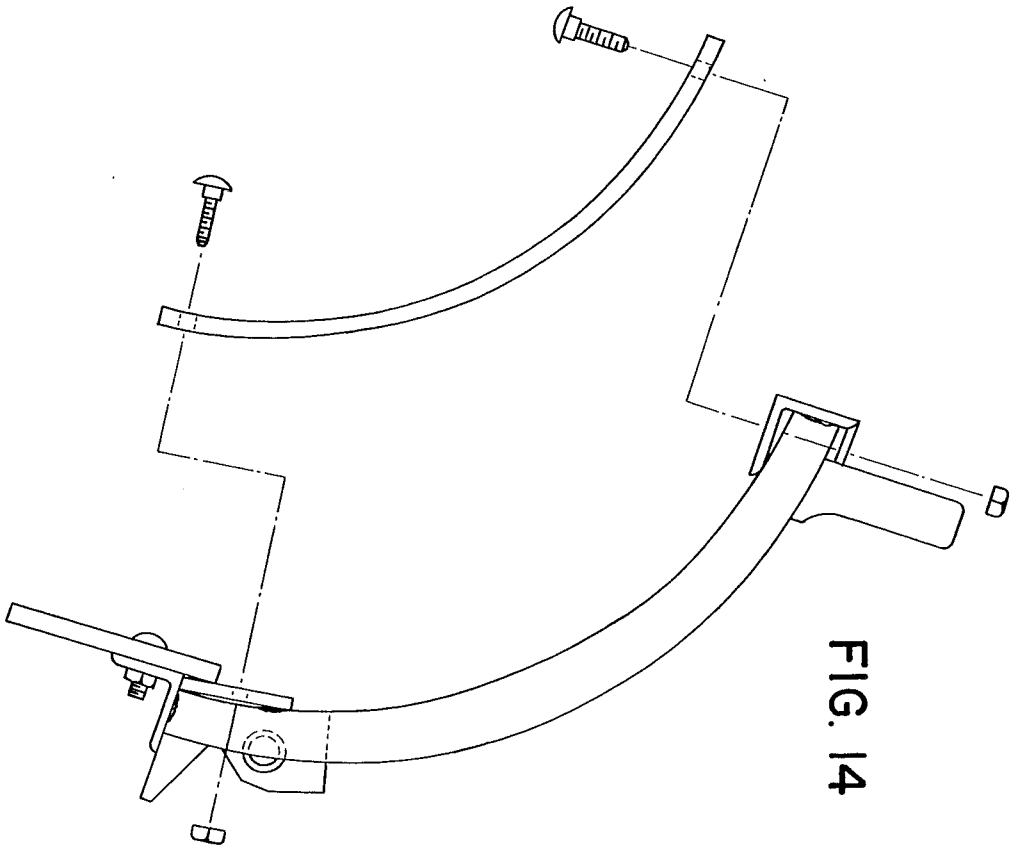
FIG. 14 is an end view of the moldboard being applied to the frame of a small plow.

Referring now to FIG. 14, a plurality of accurately drilled, round holes 84 equal in number (5) to the openings 64 adjacent top edge 65 of moldboard 18 are drilled in mounting leg 47 of top mounting member 40. Similarly, a like number (5) of round holes 85 are drilled in an accurate and precise position on bottom mounting plate 57. Preferably, the centerlines 87 of holes 84 and the centerline of holes 88 of holes 85 will intersect with one another and form approximately a right angle to assure that the inwardly curved front face 19 of moldboard 18 will extend through an arc of 90°. A plurality of threaded fasteners 90 are provided for holes 84, 85. Threaded fasteners 90 have rectilinear shanks 91, preferably square, extending from the fastener head a distance not greater than the thickness of moldboard 18 and elastomeric nuts 92. The fit between rectangular shanks 91 of fasteners 90 and rectangular opening 64 in moldboard 18 is almost a press fit so that any looseness needed to assemble moldboard 18 to frame 14 exists between the threaded end of fastener 90 and drilled holes 84, 85. As shown in FIG. 14, with threaded fasteners 90 inserted into at least some of the square openings 64 in moldboard 18, appropriate aligning studs are used to force at least initially some fasteners 90 into holes 84, 85 and moldboard 18 is prestressed or flexed into its proper configuration as nuts 92 are drawn tight. In this connection, it should be noted as described above that moldboard 18 will not maintain the curvature in its rolled condition prior to application to frame 14 and the application of fasteners 90 may in effect restore moldboard 18 to its "as rolled" condition or, alternatively, the degree of curvature of moldboard 18 may even be increased.

Referring now to FIGS. 4, 5 and 6 when moldboard 18 is assembled into frame 14 bottom edge 66 of moldboard 18 abuts or is wedged against top edge 77 of scraper blade 75 while top edge 65 is secured against movement by threaded fasteners 90 in holes 88. Alternatively, a plate abutting radially extending leg 48 of top mounting member 40 can be applied to frame 14 to serve as a solid stop abutment for top edge 65 of moldboard 18 if additional restraint is desired. However, the abutting relationship shown in FIG. 6 has been found sufficient to provide a desired strengthening of moldboard 18. As shown in FIGS. 5 and 6, when fasteners 90 are tightened, moldboard 18 is somewhat flattened to conform to the shape of the backing members.

This method of assembly should be contrasted to that heretofore used by assignee when constructing plow blades having plastic (other than polyethylene) moldboards. In the prior construction technique, the plastic moldboard was preformed and simply placed against the mounting strips and braces, and while being held thereagainst, holes were drilled and fasteners applied. Attempts to apply the polyethylene moldboard 18 of the present invention to frame 14 would not produce consistent and uniformly curved face surfaces 19 nor would the spaced distance "x" exist, or uniformly exist.

As explained above, a space exists between moldboard 18 and the inwardly curved edge surfaces 50 of braces 44 shown generally by letter "X" in the drawings and spaced distance X can vary in shape from bottom edge 66 of moldboard 18 to top edge 65 depending upon the height of flat mounting plate 57 and the attitude of radially extending leg 48 of top mounting member 40. Ideally, spaced distance X is greatest adjacent bottom mounting plate 57, although, for small plow applications where the snow is usually gathered at higher points on moldboard 18, the attitude of radially extending leg 48 can be varied to provide a more uniform spaced distance X as shown in FIG. 4. Distance X is determined relative to the degree of curvature of moldboard 18 and the thickness of moldboard 18 such that whatever flexure the distance X provides, the flexure is not sufficient to break or fracture moldboard 18.

In operation, the rigidity of moldboard 18 once installed in frame 14 is such that the shape of moldboard 18 is maintained when light or powder snow is being plowed. The low coefficient of friction permits the plow to rapidly roll the snow up along the moldboard and transversely move the snow along the face of the plow so that when the snow is powdery, there is less of a tendency for the snow to billow or spray over top edge 65 of moldboard 18 when contrasted to the operation of a conventional steel moldboard plow. When the snow is very moist or heavy, there may be certain applications where the weight of the snow coupled with the mass of the vehicle speed, etc. develops a force high enough to deflect moldboard 18 from its initially assembled position. When this occurs, it is desired that moldboard 18 flex without contacting braces 44. The distortion in the curvature does not seriously effect the rolling motion of the snow onto moldboard 18 and the springiness imparted by the deflection of the moldboard, as it tends to assume its initial assembled state within frame 14, enhances the transverse movement of the wet or compacted snow across the face 19 of moldboard 18 and more so, it is believed, than what would have occurred if moldboard 18 were assembled so as to be in contact with forward edge surfaces 50 of braces 44 without a "prestress". Braces 44, however, are needed in the event rock or debris from the roadway severely impact moldboard 18 to prevent puncture of failure thereof.

Figure 9:
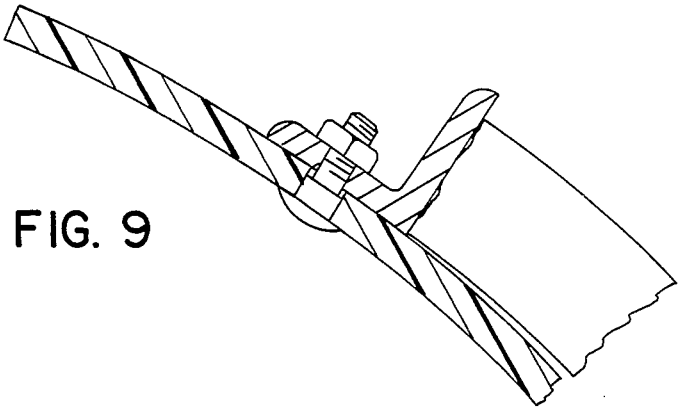
FIGS. 9 and 10 are cross-sectional views taken along lines 9—9 and 10—10 in FIG. 7, respectively, illustrating certain details of the plow construction.

Referring now to FIGS. 7 through 10, moldboard 18 is shown applied to a "large" plow application and like reference numerals used for the "small" plow description will designate like parts where applicable. The attachments to frame 14 are essentially the same as described, there being, because of the heavy duty application, a bracket 95 secured to bottom angle 56 having a threaded bore 96 for adjustingly receiving a conventional skid plate 98 normally associated with such plows. One of the differences between the large and small plow applications is the requirement in the large plow application to extend top edge 65 of moldboard 18 beyond the 90° included angle of centerlines 84, 85 to serve as additional protection against billowing of light or power snow past moldboard 18. As shown in FIG. 9, top edge 65 of moldboard 18 extends beyond mounting leg 47 of top mounting member 40 a vertical height distance of about 3″ for this purpose. In contrast to conventional steel moldboard plows which, for safety reasons, must support this extension, UHMW moldboard 18 of the present invention is unsupported since the polyethylene material will merely deflect, and not normally fracture, if impacted by debris from the roadway. The cost of frame 14 is obviously reduced.

Figure 10:
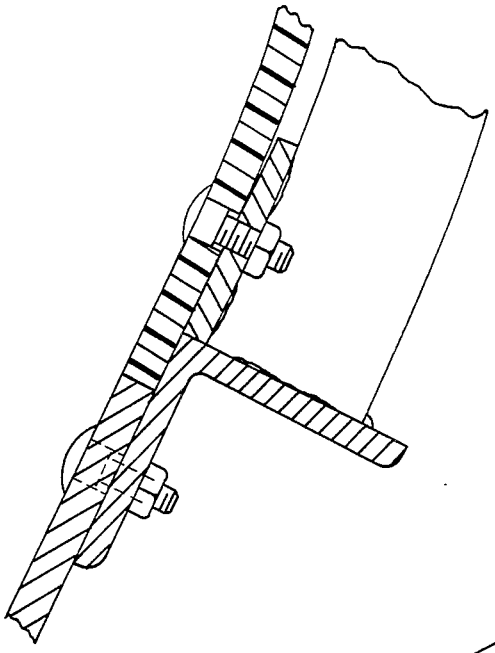
Figure 11:
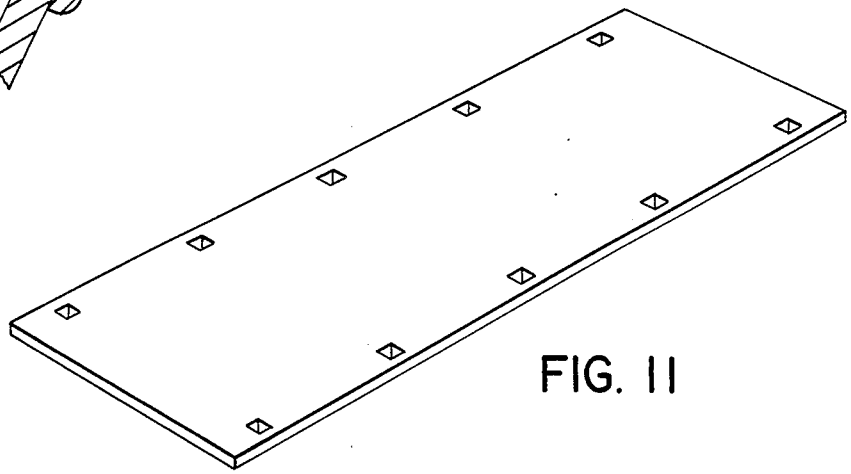
FIG. 11 is a perspective, plan view of the moldboard of the present invention illustrated in its flat condition.

FIG. 10 illustrates another difference between the large and small plow applications. In the large plow application, the degree of curvature of face 19 of moldboard 18 in an assembled position is approximately 15″. To insure sufficient bearing area for moldboard 18 adjacent the bottom portion thereof, moldboard bottom edge 66 abuts top edge 77 of scraper blade 10 along a line adjacent mounting leg 59 of bottom angle 56 (the length of mounting leg 59 being larger than that of the small plow and sufficient to support scraper blade 16). Additionally, the attitude of radially extending leg 48 of top mounting member 40 is more accurately disposed to define a spaced distance X which is crescent or moon shaped with the largest distance generally adjacent the top of bottom mounting plate 57 and tapering to a line contact with inwardly curved forward edge surfaces 50 of braces 44 adjacent mounting leg 47 of top mounting member 40. Moldboard 18 is thus assembled into frame 14 in a prestressed or flexed condition, but during operation of the large plow, flexure of moldboard 18 will only occur over an area adjacent to scraper blade 16 and continuing to a point approximately midway of the vertical height of moldboard 18. In practice, snow is not usually rolled past the vertical midpoint of moldboard 18 before it is transversely displaced across the face of the blade. Given, however, the larger radius of curvature of the large plow, the rigidity of moldboard 18 would be diminished if spaced distance were to continue somewhat uniformly between top and bottom edges 65, 66. That is, given the larger curvature, the tendency of the moldboard to deflect under heavy snow loading would increase if a uniform space were provided between moldboard 18 and inwardly curved forward edge surfaces 50 of braces 44 (notwithstanding the "prestress") and this in turn would decrease the effectiveness of moldboard 18. The crescent shaped spaced distance X thus assures the same resilient force application of the moldboard in a large plow application as that which exists in the small plow application without having to increase the thickness of moldboard 18.

In general summary, it should be understood that a polyethylene moldboard 18 of high molecular weight and generally rectangular in configuration is applied to a frame 14. Frame 14 has a spacer mechanism for securing the top and bottom portion of moldboard 18 thereto. Generally, the top spacer mechanism is determined by the plane of the top ends 52 of brace 44 and the bottom spacer mechanism is determined by the height of bottom mounting plate 57 and the degree of arcuate curvature of forward edge surfaces 50 of braces 44. Square holes 64 and square shanked fasteners 90 are used to accurately establish the arcuate curvature of the face of moldboard 18. Scraper blade 16 then abuts the bottom edge of moldboard 18 and scraper blade 16 and fastener 90 additionally assure the desired prestressed rigidity of moldboard 18 for improved blade snow removal. The spaced distance between moldboard 18 and forward edge surface 50 of braces 50 can be varied. To maintain the same moldboard thickness and also the desired curvature, the spaced distance changes from approximately an equidistant relationship for small plow applications to a crescent shaped configuration for large plow applications.

The invention has been described with reference to a preferred embodiment and it is apparent that many modifications may be incorporated into the frame and moldboard of the subject invention without departing from the sphere or essence of the invention. It is my intention to include all such modifications and alterations insofar as they come within the scope of the present invention.

It is thus the essence of my invention to provide a moldboard and a method for securing the moldboard to the frame of a snow plow which is resiliently mounted in a preflexed condition to enhance the snow removal operation of the plow.

Having thus defined my invention, I claim:

1. A plow of the type used to clear snow and debris from roadways and similar surfaces comprising:

a frame including top and bottom longitudinally extending mounting members and at least one vertically extending, arcuately shaped brace member;

a polyethylene moldboard having a low coefficient of friction; and means for fastening said moldboard to said mounting member so that said moldboard is spaced away from said forward edge surface of said brace members a predetermined distance sufficient to prevent contact between said brace and the rear surface of said moldboard during normal plow operation while permitting brace contact during excessive debris impact.

2. A plow of claim 1 wherein said fastening means secure said moldboard to said frame in a prestressed manner.

3. The plow of claim 1 wherein said moldboard is of a high molecular weight polyethylene of about $\frac{3}{8}$″ thickness.

4. The plow of claim 1 wherein said fastening means secure said moldboard to said frame in a flexed, prestressed manner to said top and bottom mounting members with a predetermined curvilinear shape which is inwardly curved.

* * * * *